US005115823A

United States Patent [19]

Keritsis

[11] Patent Number: 5,115,823

[45] Date of Patent: May 26, 1992

[54] FLAVOR-ENHANCING SMOKING FILTER

[75] Inventor: Gus D. Keritsis, Richmond, Va.

[73] Assignee: Philip Morris Incorporated, New York, N.Y.

[21] Appl. No.: 630,481

[22] Filed: Dec. 20, 1990

[51] Int. Cl.[5] ..... A24D 3/04

[52] U.S. Cl. ..... 131/336; 131/335

[58] Field of Search ..... 131/335, 336

[56] References Cited

U.S. PATENT DOCUMENTS

| | | | |
|---|---|---|---|
| 1,931,131 | 10/1933 | Haley | 131/360 |
| 2,786,471 | 3/1957 | Graybeal . | |
| 2,804,874 | 9/1957 | Visnick . | |
| 2,934,073 | 4/1960 | Killian . | |
| 2,948,282 | 8/1960 | White . | |
| 3,144,024 | 8/1964 | Eichwald et al. . | |
| 3,219,040 | 11/1965 | Kim . | |
| 3,219,041 | 11/1965 | Bromberg . | |
| 3,236,244 | 2/1966 | Irby, Jr. et al. . | |
| 3,279,476 | 10/1966 | Noznick et al. . | |
| 3,368,566 | 2/1968 | Avedikian | 131/341 |
| 3,420,241 | 1/1969 | Hind et al. . | |
| 3,485,208 | 12/1969 | Hemming et al. . | |
| 3,759,267 | 9/1973 | Thorton . | |
| 3,782,392 | 1/1974 | Monte . | |
| 3,858,587 | 1/1975 | Cavelli et al. . | |
| 3,902,504 | 9/1975 | Owens, Jr. et al. . | |
| 3,910,287 | 10/1975 | Walton . | |
| 3,913,590 | 10/1975 | Sway | 131/360 |
| 4,082,098 | 4/1978 | Owens, Jr. | 131/274 |
| 4,131,118 | 12/1978 | Gellatly et al. | 131/373 |
| 4,182,349 | 1/1980 | Selke . | |
| 4,285,349 | 8/1981 | Sprecker et al. . | |
| 4,291,711 | 9/1981 | Berger | 131/336 |
| 4,311,156 | 1/1982 | Bonnet et al. . | |
| 4,343,320 | 8/1982 | Muto . | |
| 4,423,744 | 1/1984 | Berger . | |
| 4,481,958 | 11/1984 | Rainer et al. . | |
| 4,510,950 | 4/1985 | Keritsis et al. . | |
| 4,625,737 | 12/1986 | Keritsis et al. . | |
| 4,632,131 | 12/1986 | Burnett et al. . | |
| 4,676,259 | 6/1987 | Ellis et al. . | |
| 4,756,316 | 7/1988 | Keritsis et al. . | |
| 4,759,380 | 7/1988 | Norman et al. . | |
| 4,807,809 | 2/1989 | Pryor et al. . | |
| 4,838,286 | 6/1989 | Phelpstead | 131/335 |
| 4,874,000 | 10/1989 | Tamol et al. . | |
| 4,880,018 | 11/1989 | Graves, Jr. et al. . | |
| 4,889,144 | 12/1989 | Tateno et al. | 131/335 |
| 4,966,171 | 10/1990 | Serrano et al. . | |
| 5,012,829 | 5/1991 | Thesing et al. | 131/335 |

FOREIGN PATENT DOCUMENTS

| | | | |
|---|---|---|---|
| 0232166 | 8/1987 | European Pat. Off. . | |
| 0246107 | 11/1987 | European Pat. Off. . | |
| 2315012 | 10/1973 | Fed. Rep. of Germany . | |
| 752455 | 9/1933 | France . | |
| 1152836 | 2/1958 | France . | |
| 72210 | 3/1960 | France . | |
| 0039647 | 11/1981 | France | 131/77 |
| 84/02636 | 7/1984 | PCT Int'l Appl. | 131/77 |
| 582489 | 12/1976 | Switzerland . | |
| 2229078 | 9/1990 | United Kingdom . | |

*Primary Examiner*—V. Millin
*Assistant Examiner*—Lynne A. Reichard
*Attorney, Agent, or Firm*—John R. Storella

[57] ABSTRACT

I disclose a flavor-enhancing smoking filter having at least two zones, including at least one filtering zone and at least one flavor-enhancing zone. The flavor-enhancing zone(s) have a flavorant, have a surface providing for the substantially laminar flow of smoke and permit the passage of none or a minority of the smoke drawn through the filter.

16 Claims, 1 Drawing Sheet

FLAVOR-ENHANCING SMOKING FILTER

BACKGROUND OF THE INVENTION

This invention relates to flavor-enhancing smoking filters. More particularly, this invention relates to filters in which flavorants are arrayed in zones over which smoke passes to absorb flavorant, but which zones, themselves, permit the passage of none or a minority of the smoke.

The art is continually searching for means to improve the flavor of smoke produced by a burning tobacco rod. One method to accomplish this is to have the smoke pass through an area having different quality tobacco or tobacco flavorants. The smoke incorporates flavorants, usually through volatilization, and the quality of the smoke's flavor is thereby changed. Several embodiments based on this method have been described.

Haley, U.S. Pat. No. 1,931,131, refers to a method for blending the aroma of cigarettes by connecting two cigarettes of different blends end-to-end. As the smoke of the first cigarette is drawn through the second, it incorporates flavor from the second tobacco. However, because the cigarette is long, as the smoke is drawn through the second tobacco, it may condense. The tobacco, itself, is hygroscopic and contributes to this condensation. The resulting condensation can absorb soluble flavors and remove them from the smoke.

Sway, U.S. Pat. No. 3,913,590, also refers to cigarettes having distinct tobacco sections, this time separated by an inert, porous, non-combustible element. The tobacco at the burnable end of the cigarette contains tobacco from which unwanted substances have been removed. A different kind of tobacco at the mouth end of the cigarette flavors the smoke. This cigarette poses problems of condensation and filtration similar to Haley. Furthermore, the inert element may cool the smoke so that it cannot volatilize the flavorants at the mouth end of the cigarette.

Avedikian, U.S. Pat. No. 3,368,566, refers to a filter cigarette in which the smoke from the burnable charge is extensively filtered to remove a substantial amount of the particulate matter, other combustion products and, consequently, the taste. Since all that remains is a gas stream, there is no tobacco flavor to blend or improve. Instead, Avedikian uses a charge of high quality tobacco at the mouth end of the cigarette to reflavor the gas stream produced by this filtration.

Berger, U.S. Pat. No. 4,291,711 refers to a tobacco smoke filter comprising a fibrous filtering material having a high resistance-to-draw which surrounds a reconstituted tobacco member having low resistance-to-draw. The reconstituted tobacco sheet has flow passages having a high surface area for contact with the smoke passing through. Because the reconstituted tobacco member has a low resistance-to-draw, it permits the passage of a majority of the smoke through it. Consequently, the flavorant may condense the smoke and filter flavors from it.

It is an object of this invention to provide a smoking filter which enhances the flavor of smoke passing through it but which reduces or eliminates filtration of the smoke by the flavorant.

SUMMARY OF THE INVENTION

This invention is directed to a flavor-enhancing smoking filter comprising at least two zones including at least one filtering zone and at least one flavor-enhancing zone, said flavor-enhancing zone(s) comprising a flavorant, having a surface providing for the substantially laminar flow of smoke and permitting the passage of none or a minority of the smoke drawn through the filter.

BRIEF DESCRIPTION OF THE DRAWINGS

The present invention will now be described with reference to the following drawings in which like elements are given like reference numbers throughout and in which.

DETAILED DESCRIPTION OF THE INVENTION

This invention is directed to a smoking filter that uses a flavorant to significantly enhance the flavor of smoke produced from a burning tobacco rod or other flavor-generating smoking article, but which eliminates or greatly reduces filtration of the smoke by that flavorant. The filters of this invention have flavor-enhancing zones that provide a surface containing a flavorant over which the smoke flows in substantially laminar fashion. The passing smoke absorbs flavors from the flavorant but is not condensed by it. Consequently, the flavorant does not filter other flavors from the smoke. According to certain embodiments, the flavor-enhancing zones permit the passage of some of the smoke, as long as they pass only a minority of the smoke drawn through the filter.

Figure 1:
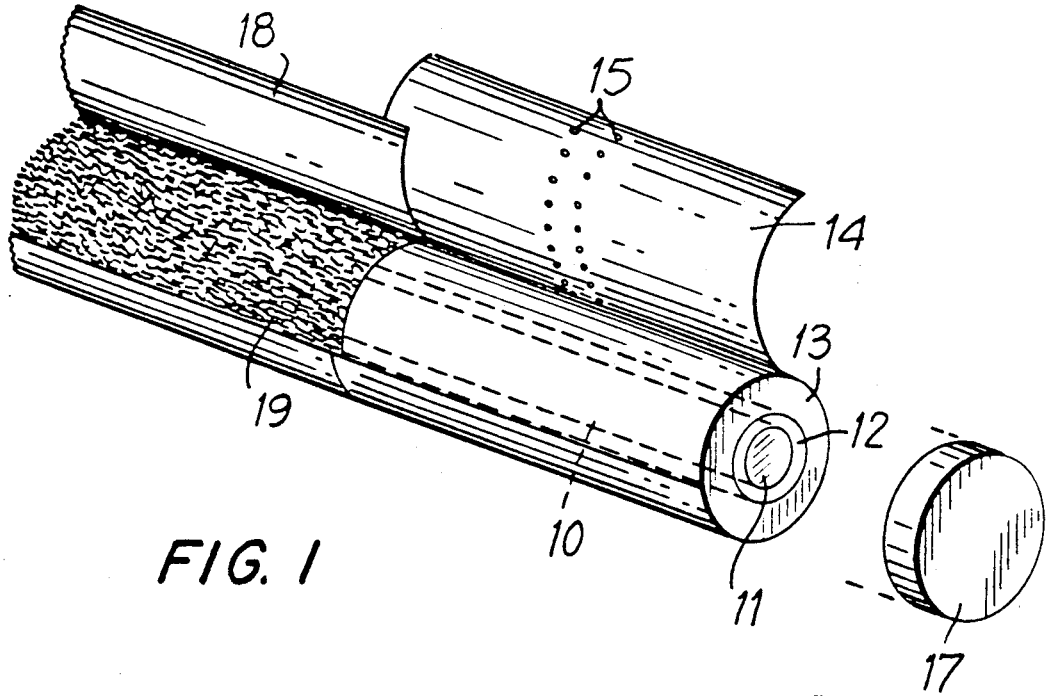
FIG. 1 is a mouth end perspective view of a cigarette having a filter which has a central filtering zone, an intermediate flavor-enhancing zone and a peripheral filtering zone.

Referring now to FIG. 1, the preferred embodiment of the invention, smoking filter 10 comprises three zones concentric about the longitudinal axis of the filter. Central filtering zone 11 forms the core of the filter. Intermediate flavor-enhancing zone 12, which comprises a flavorant, surrounds central filtering zone 11. Peripheral filtering zone 13 surrounds intermediate flavor-enhancing zone 12. Filter 10 has a wrapping of conventional tipping paper 14. Filter 10 can be recessed. A recessed filter conveniently accommodates optional, annular mouthpiece plug 17, made of filter material, which keeps flavorant particles out of the smoker's mouth. Filter 10 is attached to tobacco rod 19. Tobacco rod 19 is wrapped in conventional paper 18. One can also attach filter 10 to other flavor-generating smoking articles, such as those described in Serrano et al., U.S. Pat. No. 4,966,171, incorporated herein by reference.

The filtering zones comprise any of the conventional filtering media known to the art. Most smoking filters, particularly cigarette filters sold commercially as part of cigarettes, comprise a cylindrical rod or "plug." The plug may be formed from a "tow" of fibers of plasticized cellulose acetate, rayon, polypropylene, paper or combinations thereof. One may also form the plug from an appropriate web or sheet of these materials. When such web or sheet materials are used as filters, they are frequently corrugated. Webs may also be creped to improve tensile strength. The web or sheet material is then gathered to form a cylindrical plug. Plugs are typically bound by a plug wrap of paper or film, such as cellulose acetate, that holds the plug together.

Intermediate flavor-enhancing zone 12 surrounds central filtering zone 11 and comprises a flavorant. Useful flavorants for flavor-enhancing zone 12 include reconstituted tobacco, tobacco paste, tobacco solubles and ground or particulated tobacco.

Preferably, flavor-enhancing zone 12 comprises a plug wrap which binds central filtering zone 11 and which provides a matrix for the flavorant. Most preferably, flavor-enhancing zone 12 comprises a sheet of reconstituted tobacco. U.S. Pat. Nos. 3,420,241, 3,782,392 and 4,182,349 describe how to construct such sheets.

Flavor-enhancing zone 12 may also comprise a conventional plug wrap that has been treated with a flavorant. For example, one could coat the plug wrap with tobacco paste.

Also, one may treat the plug wrap with tobacco solubles. Any method for extracting water soluble components from tobacco which allows the extracted components to be concentrated and applied will be suitable to practice this embodiment of the invention. In general, tobacco strips, shreds or powder are soaked with agitation in water for about 10 minutes. The tobacco is filtered and re-soaked. Then the filtrates are combined and concentrated.

The tobacco solubles may be applied to the plug wrap using methods known to those in the art. These include using either a spray or a coating/dipping roll. One may add other soluble flavorants to the plug wrap in a similar fashion.

One also may produce a plug wrap containing ground or particulated tobacco or a blend of tobaccos by adding these particles to the formed paper or film (wet or dry) or by pulping them with the matrix fibers during the paper- or film-making process. The tobaccos are preferably selected from the group consisting of Virginia Flue Cured Bright, Virginia Sun Cured, Virginia Dark Air Cured, Burley, Oriental (such as Samsun, Basma and blends). Blended tobaccos from various flavored, commercially available American cigarettes are also useful.

I also contemplate filters in which the flavor-enhancing zone does not comprise a plug wrap. For example, one may coat a plug directly with tobacco paste. The tobacco paste may be applied to a fibrous web or tow as a liquid foam according to the methods described in U.S. Pat. No. 4,756,316, which is incorporated herein by reference. Also, it may be extruded from the outer annulus of a double annulus nozzle to provide a sheath of paste to the outer surface of a filter rod extruded through the central annulus of the nozzle. According to another such embodiment, the flavor-enhancing zone comprises a reconstituted tobacco sheet that surrounds a conventionally wrapped plug.

Flavor-enhancing zone 12 is, in turn, surrounded by peripheral filtering zone 13. This zone, again, may be composed of any suitable filtering material and is generally wrapped in a plug wrap.

Because the surface of flavor-enhancing zone 12 is substantially planar, smoke passes over it in a laminar flow and thereby incorporates flavorants. However, since the zone is essentially a thin layer, it does not permit the longitudinal passage of smoke through it or appreciably filter the smoke passing along its matrix. Since, in this case, the flavor-enhancing zone is in contact with both the central and peripheral filtering zones, the smoke can absorb flavor from both its inner and outer surfaces.

Several modifications to the filter will improve the flow characteristics of the smoke so that it can absorb more flavorants. In a preferred embodiment, tipping paper 14 is perforated with ventilation holes 15. When the smoker puffs on the smoking filter during the act of smoking, air is drawn through these ventilation holes. This forces the smoke from the tobacco rod 19 medially into filter 10 and concentrates it in laminar flow over the surface of flavor-enhancing zone 12 at a point past the ventilation holes.

Also, central filtering zone 11 may be constructed to possess a higher resistance-to-draw (RTD) than peripheral filtering zone 13 so that smoke is forced over the outer surface of flavor-enhancing zone 12 rather than through central filtering zone 11.

Figure 2:
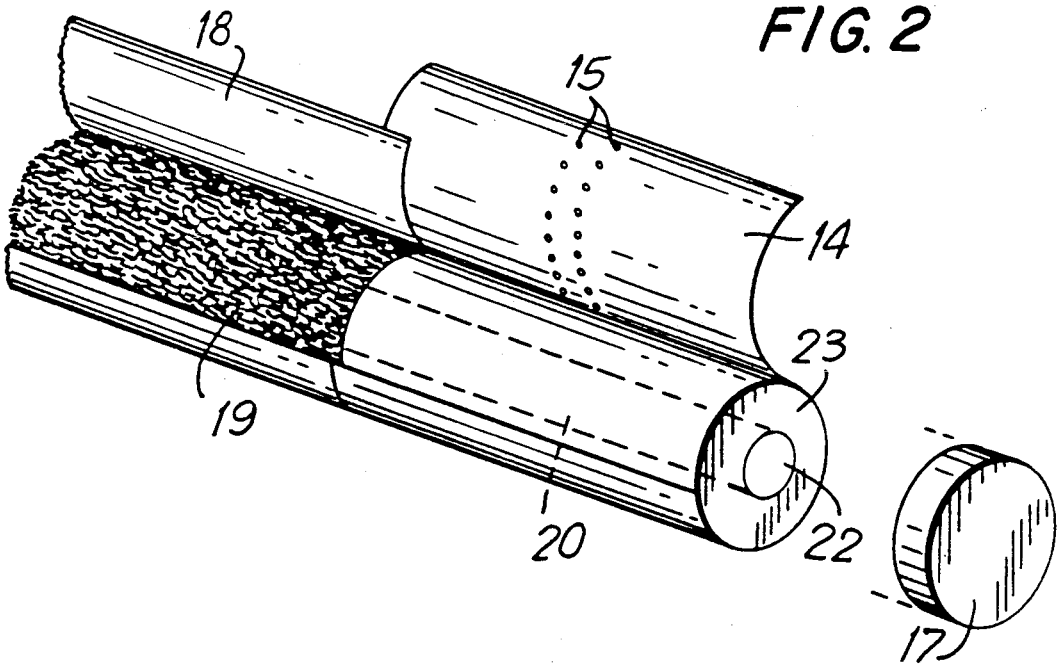
FIG. 2 is a mouth end perspective view of a cigarette having a filter which has a central flavor-enhancing zone and a peripheral filtering zone.

Referring now to FIG. 2, another embodiment of the invention, smoking filter 20 comprises two zones, central flavor-enhancing zone 22 is surrounded by peripheral filtering zone 23. Central flavor-enhancing zone 22 provides a surface which directs a substantially laminar flow of smoke over it. Also, one may provide filter 20 with tipping paper 14 having perforations 15 or mouthpiece plug 17.

Most preferably flavor-enhancing zone 22 comprises a material that is substantially impermeable to penetration by the smoke. In one embodiment, flavor-enhancing zone 22 comprises a rigid, very dense extruded tobacco rod. U.S. Pat. Nos. 4,510,950, 4,625,737, 4,632,131, 4,874,000 and 4,880,018 describe the production of extruded rods or strands. One may adjust the density to produce rods that are substantially air-impermeable. One method to accomplish this is to minimize or eliminate the steaming step to prevent foaming. Another method is to radially compress the foamed tobacco rod during the rod-making or filter-making operations.

Flavor-enhancing zone 22 may also comprise an inert, air-impermeable material surrounded by a reconstituted tobacco sheet or coated with tobacco paste. Suitable materials include highly plasticized cellulose acetate fused into a single plug and extruded polypropylene or polyethylene rods of the desired diameter.

Alternatively, flavor-enhancing zone 22 may comprise a substantially planar or one-dimensional material whose volume is so small that smoke passes over its surface rather than through it. For example, flavor-enhancing zone 22 can comprise an elongated sliver of a reconstituted tobacco sheet, with a width less than the diameter of filter 20. Also, flavor-enhancing zone 22 can comprise an elongated strand of tobacco or intertwined strands of tobacco that stretch the length of filter 20.

Although, most preferably, flavor-enhancing zone 22 is substantially impermeable to the passage of smoke, I also contemplate flavor-enhancing zones that permit the passage of a minority of the smoke. Such embodiments achieve one aim of this invention, to limit the filtration of the smoke by the flavorant. These flavor-enhancing zones still have a surface which provides for the substantially laminar flow of smoke over them.

One can easily construct filters wherein flavor-enhancing zone 22 permits the passage of a minority of the smoke by regulating the relative RTD of the flavor-enhancing and filtering zones. In order for a minority of the smoke to pass through the flavor-enhancing zone, the RTD of the flavor-enhancing zone must be greater than the RTD of the filtering zone. Preferably, the RTD of the flavor-enhancing zone is at least 40% greater than that of the filtering zone. The art is aware of many variables available to manipulate the RTD of a material. These include its relative cross-sectional area in the filter, density, and relative void volume, which one can control as a function of compression or the size of denier.

According to one embodiment of a filter having a flavor-enhancing zone that permits the passage of a minority of the smoke, flavor-enhancing zone 22 comprises a tightly rolled, reconstituted tobacco sheet with RTD greater than surrounding filtering zone 23.

In another such embodiment, flavor-enhancing zone 22 comprises an extruded tobacco rod with some permeability to the passage of smoke. One can regulate the RTD of such a rod by regulating the amount of foaming during its manufacture or by compressing the extruded rod by a limited amount.

Flavor-enhancing zone 22 also may be constructed of a filtering material, as hereinbefore defined, which also comprises a flavorant. If the filtering material is a web or sheet, tobacco may be ground or particulated and then added to the formed web or sheet (wet or dry), or the tobacco may be pulped with the cellulose and/or other fibers during the webor sheet-making process. If the filtering medium is a tow, such as cellulose acetate, the tow may be impregnated with tobacco in the form of shreds, strands, or particles after being bloomed (spread) during its processing into filter rods.

Also, one may treat the filtering material with tobacco solubles as hereinbefore described. Furthermore, filtering tows, webs or sheets may be treated using the same solutions and methods as described in U.S. Pat. No. 4,756,316 for the application of tobacco paste. The preferred amount of tobacco solubles is 0.5% to 50% of the dry weight of the filtering material. The most preferred amount of water soluble extracts is from 1% to 20% of the dry weight of the filtering material.

Flavor-enhancing zone 22 also may comprise shredded tobacco of the kinds already described.

FIGS. 1 and 2 show filters in which a filtering zone is the outermost zone. However, I also contemplate filters in which the flavor-enhancing zone surrounds the filtering zone. According to one embodiment, the flavor-enhancing zone comprises the outer plug wrap of an ordinary filter. The plug wrap contains flavorants provided, for example, by any manner described herein.

Finally, I contemplate filters having a plurality of flavor-enhancing zones, for example, two concentric flavor-enhancing zones separated by a filtering zone.

While I have described herein a number of embodiments of this invention, it is apparent that one of skill in the art could alter my constructions to provide other embodiments that utilize the processes and manufactures of this invention. Therefore, one will appreciate that the scope of this invention is to be defined by the claims appended hereto rather than by the specific embodiments that I have presented by way of example.

I claim:

1. A flavor-enhancing smoking filter comprising:

(1) a central filtering zone;

(2) an intermediate flavor-enhancing zone comprising a flavorant, having a surface providing for the substantially laminar flow of smoke and permitting the passage of none or a minority of the smoke drawn through the filter; and (3) a peripheral filtering zone.

2. The filter according to claim 1 wherein the intermediate flavor-enhancing zone comprises a plug wrap.

3. The filter according to claim 2 wherein the plug wrap comprises a reconstituted tobacco sheet.

4. The filter according to claim 3 further comprising a wrapping of tipping paper having ventilation holes.

5. The filter according to claim 3 further comprising a mouthpiece plug.

6. The filter according to claim 2 wherein the plug wrap comprises a flavorant selected from the group consisting of tobacco paste, tobacco solubles and ground or particulated tobacco.

7. The filter according to claim 7 further comprising a wrapping of tipping paper having ventilation holes.

8. The filter according to claim 7 wherein the plug wrap comprises ground or particulated tobacco or a blend of tobaccos comprising at least one tobacco selected from the group consisting of Virginia Flue Cured Bright, Virginia Sun Cured, Virginia Dark Air Cured, Burley and Oriental.

9. The filter according to claim 2 wherein the flavor-enhancing zone comprises a reconstituted tobacco sheet that surrounds a conventionally wrapped plug or a tobacco paste which coats a plug.

10. The filter according to claim 2 wherein the RTD of the central filtering zone is greater than the RTD of the peripheral filtering zone.

11. A flavor-enhancing smoking filter comprising:

(1) a central flavor-enhancing zone comprising a flavorant and having a surface providing for the substantially laminar flow of smoke, said central flavor-enhancing zone comprising a material substantially impermeable to the passage of smoke, and (2) a peripheral filtering zone.

12. The filter according to claim 11 wherein the material comprises a very dense extruded tobacco rod.

13. The filter according to claim 12 further comprising a wrapping of tipping paper having ventilation holes.

14. The filter according to claim 11 wherein the material comprises an inert, air-impermeable material surrounded by a reconstituted tobacco sheet or coated with tobacco paste.

15. The filter according to claim 14 further comprising a wrapping of tipping paper having ventilation holes.

16. The filter according to claim 11 wherein the central flavor-enhancing zone comprises an elongated sliver of a reconstituted tobacco sheet with width less than the diameter of the filter or an elongated strand of tobacco or intertwined strands of tobacco.

* * * * *